US010320118B2

(12) United States Patent
Paul

(10) Patent No.: US 10,320,118 B2
(45) Date of Patent: Jun. 11, 2019

(54) CONNECTOR WITH A LATCHING ASSEMBLY

(71) Applicant: Polamco Limited, Bath (GB)

(72) Inventor: Martin Paul, Bristol (GB)

(73) Assignee: Polamco Limited, Bath (GB)

( * ) Notice: Subject to any disclaimer, the term of this patent is extended or adjusted under 35 U.S.C. 154(b) by 0 days.

(21) Appl. No.: 15/689,730

(22) Filed: Aug. 29, 2017

(65) Prior Publication Data

US 2018/0062308 A1 Mar. 1, 2018

(30) Foreign Application Priority Data

Aug. 30, 2016 (EP) ..... 16186399

(51) Int. Cl.

| | |
|---|---|
| ***H01R 13/62*** | (2006.01) |
| ***H01R 13/622*** | (2006.01) |
| ***H01R 13/625*** | (2006.01) |
| ***H01R 13/627*** | (2006.01) |
| *H01R 13/64* | (2006.01) |

(52) U.S. Cl.

CPC ..... *H01R 13/622* (2013.01); *H01R 13/625* (2013.01); *H01R 13/6276* (2013.01); *H01R 13/64* (2013.01)

(58) Field of Classification Search

CPC ..... H01R 13/625

USPC ..... 439/310, 318, 320

See application file for complete search history.

(56) References Cited

U.S. PATENT DOCUMENTS 2,703,870 A * 3/1955 Minto ..... H01R 13/523 439/205
2,987,691 A * 6/1961 Ross ..... H01R 13/625 439/294
3,111,355 A * 11/1963 Samburoff ..... H01R 13/631 439/159
3,287,031 A * 11/1966 Simmons ..... H01R 13/6456 285/27
3,345,604 A * 10/1967 Ernst ..... H01R 13/62933 439/310
3,440,371 A * 4/1969 Stewart ..... H02B 11/133 200/38 FA
3,629,791 A * 12/1971 Normann ..... H01R 13/62933 439/293
4,629,272 A * 12/1986 Mattingly ..... H01R 13/625 439/318
4,744,770 A * 5/1988 Drogo ..... H01R 13/64 439/310

(Continued)

FOREIGN PATENT DOCUMENTS

| | | |
|---|---|---|
| WO | 9015282 A1 | 12/1990 |
| WO | 0620615 A2 | 10/1994 |
| WO | 2007071968 A2 | 6/2007 |

OTHER PUBLICATIONS

European Search Report, dated Mar. 3, 2017, 9 pages.

*Primary Examiner* — Neil Abrams
(74) *Attorney, Agent, or Firm* — Barley Snyder

(57) ABSTRACT

A connector comprises a latching assembly, a connector body, and a fixation sleeve. The fixation sleeve is rotatably held on the connector body by the latching assembly between a first latching position and a second latching position. The fixation sleeve is disposed at a different angular position relative to the connector body in the first latching position than in the second latching position.

18 Claims, 4 Drawing Sheets

(56) References Cited

U.S. PATENT DOCUMENTS

| | | | | | |
|---|---|---|---|---|---|
| 4,836,794 | A * | 6/1989 | Barr | H01R 13/6583 | 439/135 |
| 4,917,525 | A * | 4/1990 | Duncan | H01R 13/625 | 285/93 |
| 4,984,995 | A * | 1/1991 | Tucker | H01R 13/622 | 285/81 |
| 5,010,426 | A * | 4/1991 | Krenz | G11B 25/043 | 360/137 |
| 5,082,454 | A * | 1/1992 | Tonkiss | H01R 13/622 | 439/312 |
| 5,111,360 | A * | 5/1992 | Baba | B60R 11/0241 | 361/727 |
| 5,505,632 | A * | 4/1996 | Hayashi | H01R 13/625 | 439/318 |
| 7,422,460 | B2 * | 9/2008 | Cheng | H01R 11/282 | 439/259 |
| 8,246,372 | B1 * | 8/2012 | Walters | H01R 13/622 | 439/310 |
| 8,270,153 | B2 * | 9/2012 | Song | H01R 13/6683 | 361/679.42 |
| 8,405,253 | B2 * | 3/2013 | McCoy | H01R 13/71 | 307/116 |
| 9,112,307 | B2 * | 8/2015 | Leroyer | H01R 13/639 | |
| 9,496,643 | B2 * | 11/2016 | Kato | H01R 13/623 | |
| 2018/0062308 | A1 * | 3/2018 | Paul | H01R 13/622 | |

* cited by examiner

CONNECTOR WITH A LATCHING ASSEMBLY

CROSS-REFERENCE TO RELATED APPLICATION

This application claims the benefit of the filing date under 35 U.S.C. § 119(a)-(d) of European Patent Application No. 16186399.8, filed on Aug. 30, 2016.

FIELD OF THE INVENTION

The present invention relates to an electrical connector and, more particularly, to an electrical connector having a latching assembly.

BACKGROUND

Known electrical connectors have a connector body and a fixation sleeve held on the connector body and rotatable with respect to the connector body. The fixation sleeve, which comprises at least one fixation element, locks the connector to a mating connector by rotating relative to the connector body. A rotational position of the fixation sleeve with respect to the connector body may require adjustment to facilitate the mating and locking of the connector with the mating connector.

SUMMARY

A connector according to the invention comprises a latching assembly, a connector body, and a fixation sleeve. The fixation sleeve is rotatably held on the connector body by the latching assembly between a first latching position and a second latching position. The fixation sleeve is disposed at a different angular position relative to the connector body in the first latching position than in the second latching position.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
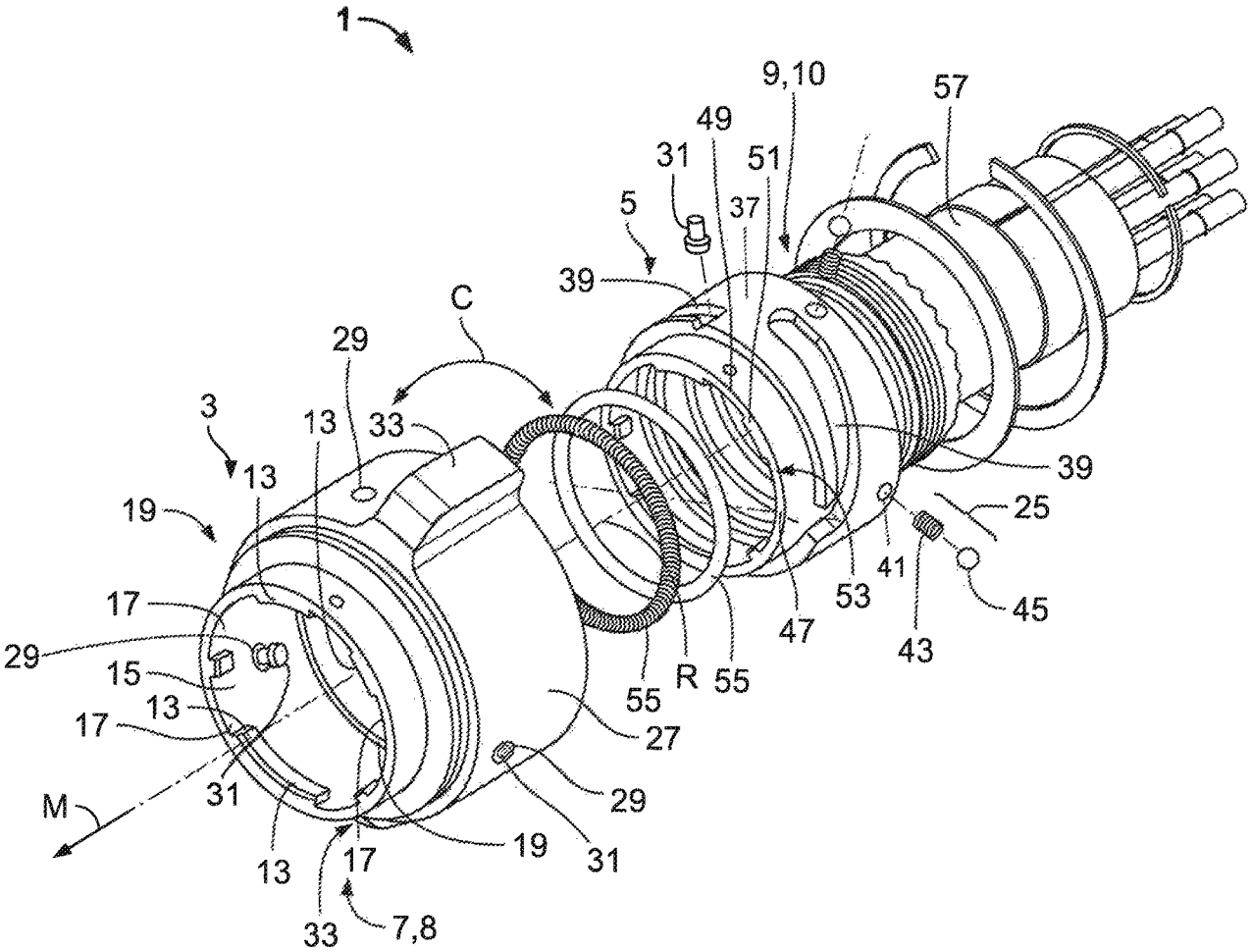
FIG. 1 is an exploded perspective view of a connector according to the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

A connector 1 according to the invention is shown in FIG. 1. The connector 1 comprises a fixation sleeve 3 and a connector body 5. The fixation sleeve 3 has a front end 7 which also defines a front end 8 of the connector 1. The connector body 5 has a rear end 9 which also defines a rear end 10 of the connector 1. The connector 1 is mateable along a mating direction M with the mating connector 11, shown in FIG. 2, wherein the mating direction M extends from the rear end 10 towards the front end 8.

The fixation sleeve 3, as shown in FIG. 1, is rotatable around an axis of rotation R. The fixation sleeve 3 has an overall substantially cylindrical shape. The fixation sleeve 3 has a plurality of fixation elements 13 disposed at the front end 7 of the fixation sleeve 3. The fixation elements 13 project from an inner circumference 15 of the fixation sleeve 3 towards the rotational axis R. The fixation elements 13 are intersected by recesses 17 along a circumferential direction C around the rotational axis R. The fixation elements 13 and the recesses 17 together form a first alignment member 19 of the connector 1.

Figure 4:
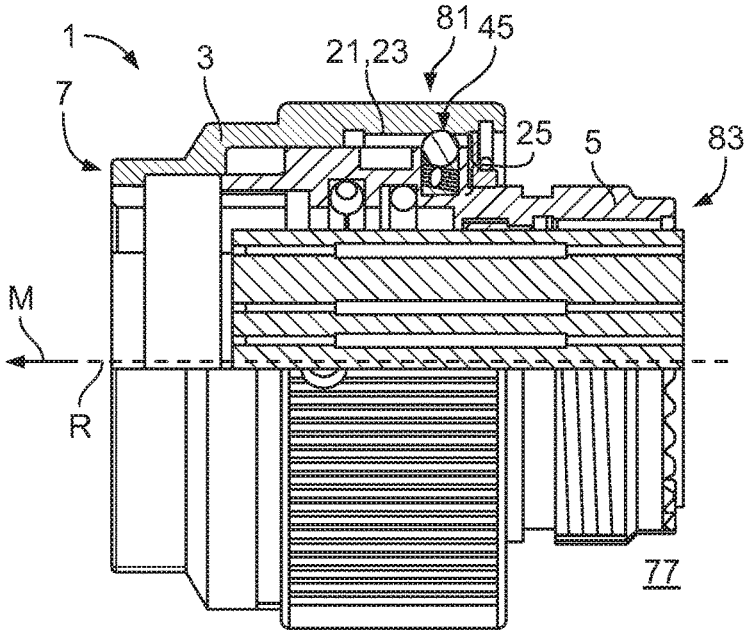
FIG. 4 is a sectional side view of the connector of FIG. 1 in the first latching position.

The fixation sleeve 3, as shown in FIG. 4, has a plurality of grooves 21 disposed at the inner circumference 15 and extending substantially parallel to the rotational axis R.

An outer wall 27 of the fixation sleeve 3, which extends along the circumferential direction C, has a plurality of passageways 29 as shown in FIG. 1. In the shown embodiment, the passageways 29 are equally spaced along the circumferential direction C on the outer wall 27 and each of the passageways 29 has one of a plurality of pins 31 disposed therein. The fixation sleeve 3 has a plurality of wings 33 each shaped as a wing nut 35 extending from the outer wall 27.

The connector body 5, as shown in FIG. 1, has an overall substantially cylindrical shape and is at least partially disposed inside the fixation sleeve 3 in an assembled state. On an outer circumference 37, the connector body 5 has a plurality of cam tracks 39. The number of cam tracks 39 is identical to the number of passageways 29. The cam tracks 39 extend around the axis of rotation R. Each cam track 39 is open in the mating direction M and one of the pins 31 is inserted into each the cam track 39 during assembly. The cam tracks 39 are closed counter to the mating direction M. In an alternative embodiment, the cam tracks 39 may be open counter to the mating direction M and closed in the mating direction M.

The connector body 5, as shown in FIG. 1, has a plurality of recesses 41 in the outer circumference 37. In the shown embodiment, four recesses 41 are formed as blind holes. The recesses 41 are equally spaced to each other along the circumferential direction C; in the shown embodiment, the four recesses 41 are spaced with an angular distance of 90° to each other. The recesses 41 each receive an elastically deformable latch 25. The elastically deformable latches 25, as shown in FIG. 1, each have a compression spring 43 and a ball 45 disposed on an end of the compression spring 43.

The connector body 5, on its inner circumference 47 as shown in FIG. 1, has a second alignment member 49. The second alignment member 49 has a plurality of projections 51 and recesses 53. The projections 51 project from the inner circumference 47 in the direction of the rotational axis R, whereas the recesses 53, similarly to the first alignment member 19 of the connector 1, are arranged in between the projections 51 along the circumferential direction C.

The connector 1, as shown in FIG. 1, has a plurality of seals 55 disposed between the connector body 5 and the fixation sleeve 3 in an assembled state. The connector body 5 may carry electrical contacts (not shown), which may be arranged in a contact arrangement 57, and are insertable into the connector body 5.

Figure 2:
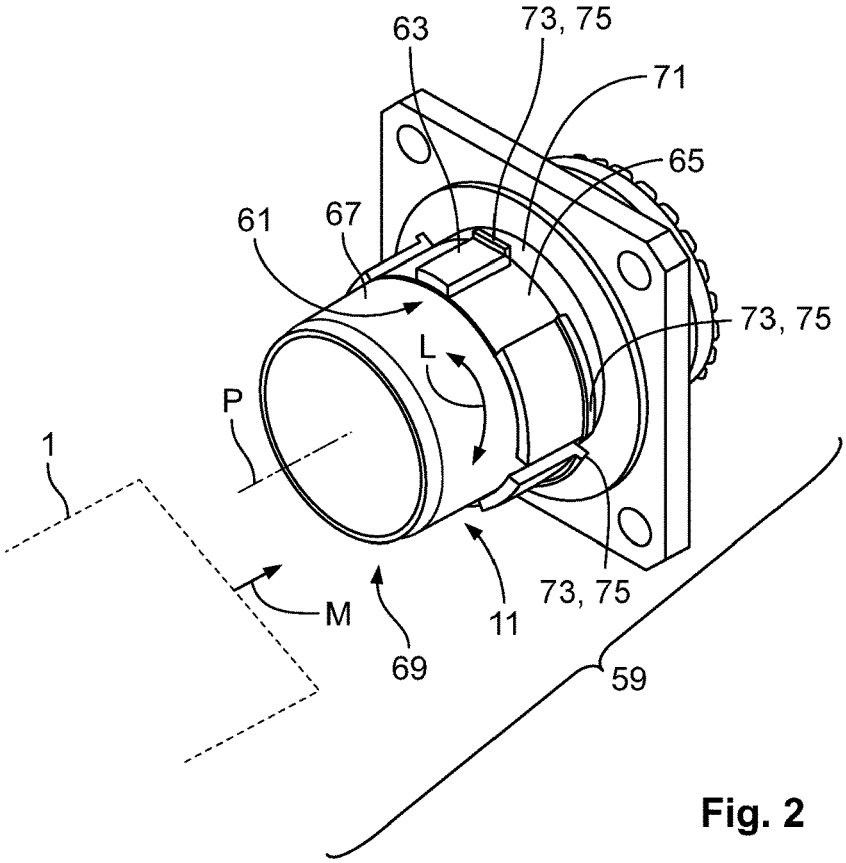
FIG. 2 is a perspective view of a mating connector.

A mating connector 11 matable with the connector 1 is shown in FIG. 2; the mating connector 11 and the connector 1 form a connector assembly 59.

The mating connector 11, as shown in FIG. 2, has an overall cylindrical shape. The mating connector 11 has a mating alignment member 61, which comprises projections 63 and gaps 65 disposed between the projections 63 along a circumferential direction C. In a mated position between the connector 1 and the mating connector 11, the cylindrical shape of the mating connector 11 extends around the rotational axis R of the connector 1. The mating connector 11 has a rotational axis P and a circumferential direction L. The projections 63 project from an outer circumference 67 of the mating connector 11 and extend radially with respect to the rotational axis P.

The mating connector 11, as shown in FIG. 2, has a front end 69 and a rear end 71. The front end 69 of the mating connector 11 projects along the rotational axis P and is the first part of the mating connector 11 brought into contact with the connector 1 during mating. At rear ends 73 of the projections 63, which point towards the rear end 71 of the mating connector 11, the projections 63 project further from the outer circumference 67 then at the remaining parts of the projections 63. These regions form counter fixation elements 75 of the mating connector 11. The circumferential shape of the mating connector 11 in the region of the counter fixation elements 75 is formed complementary to the fixation elements 13 and the recesses 17 of the fixation sleeve 3. The counter fixation elements 75 pass through the recesses 17 of the fixation sleeve 3 along the mating direction M.

The assembly of the connector 1 will now be described with reference to FIGS. 3-6.

Figure 3:
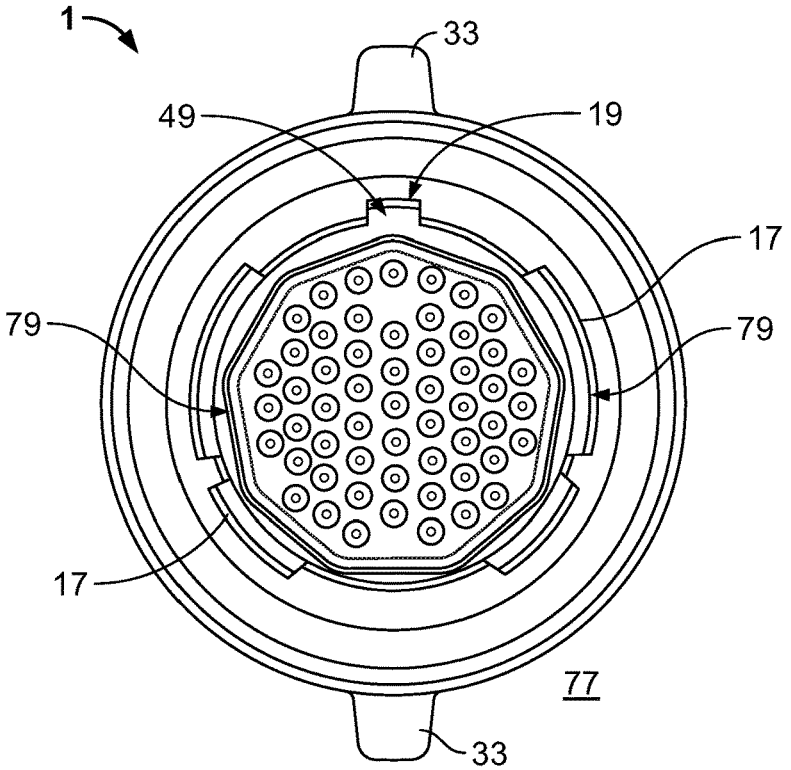
FIG. 3 is a front view of the connector of FIG. 1 in a first latching position.
Figure 5:
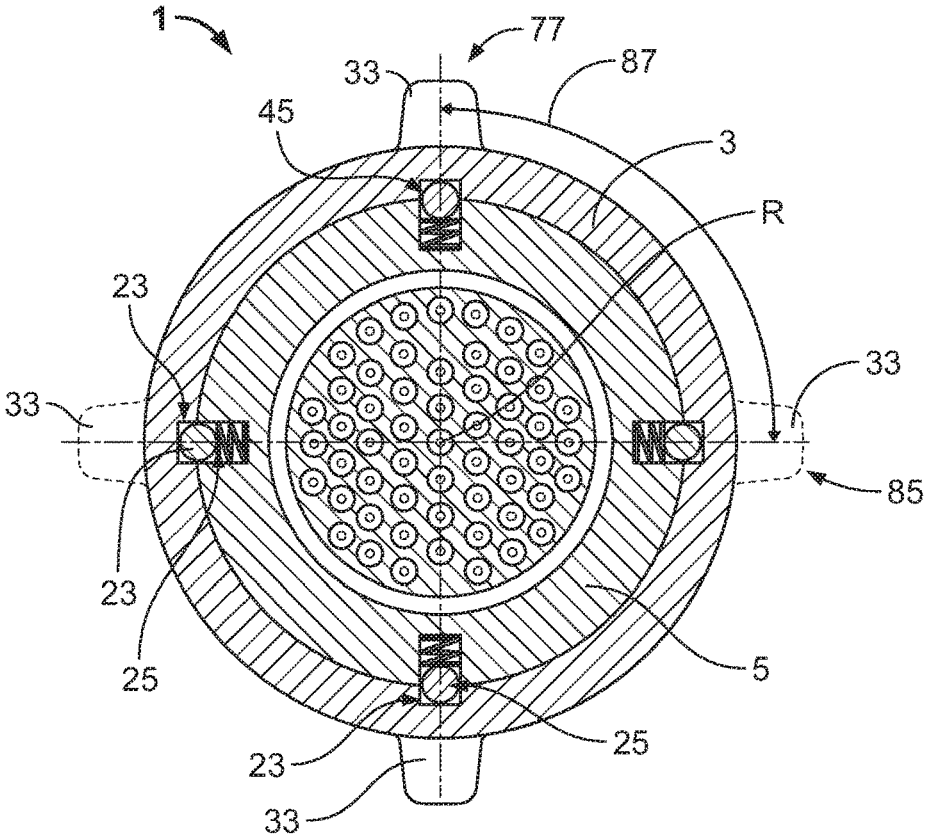
FIG. 5 is a sectional front view of the connector of FIG. 1 taken through a latching assembly of the connector.

The connector 1 is shown in a first latching position 77 in FIGS. 3-5, in which the first alignment member 19 and the second alignment member 49 are aligned to each other such that uninterrupted insertion paths 79 are formed. The insertion paths 79 allow the insertion of the projections 63 of the mating connector 11 into the connector 1. In order to allow the counter fixation element 75 of the mating connector 11 to pass the recesses 17 in the fixation sleeve 3, the recesses 17 extend further into the inner circumference 15 of the fixation sleeve 3 than the recesses 53 extend into the inner circumference 47 of the connector body 5.

When the connector body 5 is inserted in the fixation sleeve 3, the ball 45 is in contact with the inner circumference 15 of the fixation sleeve 3. As shown in FIG. 4, the grooves 21 of the fixation sleeve 3 constitute receiving recesses 23 receiving the ball 45 of the latches 25 in an assembled state when the first latching position 77 is reached. The latches 25 of the connector body 5 and the receiving recesses 23 of the fixation sleeve 3 together form a latching assembly 81. In the first latching position 77, as shown in FIGS. 4 and 5, the connector body 5 is arranged in a pre-connection position 83, in which it is disposed inside the fixation sleeve 3 and positioned rearward in the direction counter to the mating direction M from the front end 7 of the fixation sleeve. The fixation sleeve 3 is rotatably connected to the connector body 5 in the first latching position 77.

In FIG. 5, the first latching position 77 is indicated by the solid lines for the wings 33 of the fixation sleeve 3. A second latching position 85 is indicated by the dashed lines of the same wings 33. The connector 1 is shown in a second latching position 85 in FIGS. 5 and 6. The connector 1 is moved from the first latching position 77 to the second latching position 85 by rotating the fixation sleeve 3 by an angle of rotation 87 around the connector body 5. In the shown embodiment, which comprises four latches 25 and four receiving recesses 23, the angle of rotation 87 is 90°.

Figure 6:
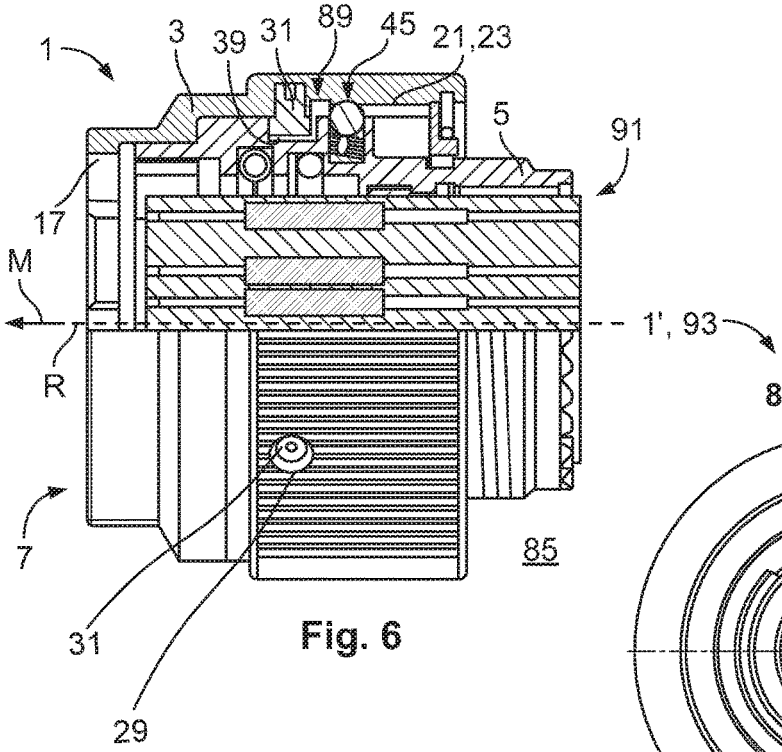
FIG. 6 is a sectional side view of the connector of FIG. 1 in a second latching position.

The pin 31 and the cam track 39 together form a drive system 89 of the connector 1, shown in FIG. 6. The pin 31 extends into the cam track 39 and a rotation of the fixation sleeve 3 is converted into an axial movement of the connector body 5 due to the cam track 39 which extends around the rotational axis R. Further, during rotation of the fixation sleeve 3 with respect to the connector body 5, the ball 45 moves in the groove 21 and is in contact with the inner circumference 15 of the fixation sleeve 3.

In the second latching position 85, the connector body 5 is driven towards the front end 7 of the fixation sleeve 3 and situated in a connection position 91 shown in FIG. 6. In the second latching position 85, each ball 45 is situated in a different receiving recess 23 than in the first latching position 77. The groove 21 shape allows the latches 25 to enter the receiving recesses 23 even if the connector body 5 has been driven along the rotational axis R.

In the second latching position 85, as shown in FIG. 6, the first alignment member 19 and the second alignment member 49 are rotated relative to each other. Therefore, the insertion paths 79 are interrupted. If the connector 1 has been mated with a mating connector 11 while in the first latching position 85, and the fixation sleeve 3 has afterwards been rotated by the angle of rotation 87 such that the latching assembly 81 is situated in the second latching position 85, then the fixation elements 13 are arranged behind and locked to the counter fixation elements 75 of the mating connector 11 in the mating direction M in a mated state of the connector 1 and the mating connector 11. Further, the connector body 5 is driven towards the front end 7 in the second latching position 85 positioning elements in the connector body 5 to be in contact with complementary elements of the mating connector 11.

Figure 7:
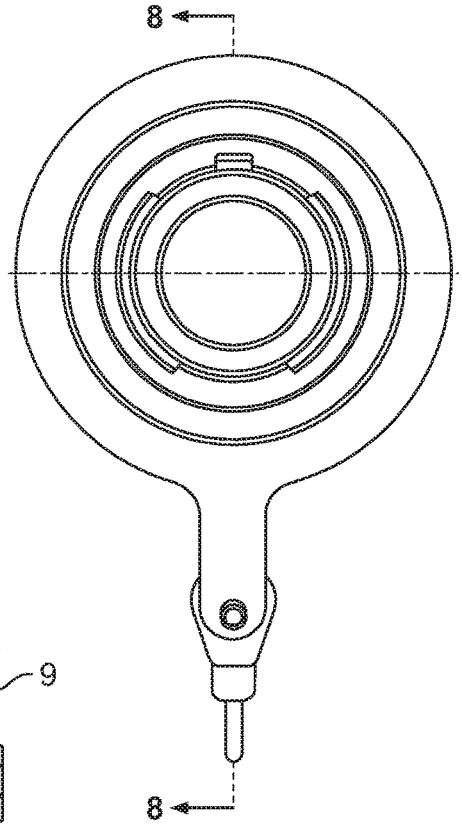
FIG. 7 is a front view of a connector according to another embodiment of the invention.
Figure 8:
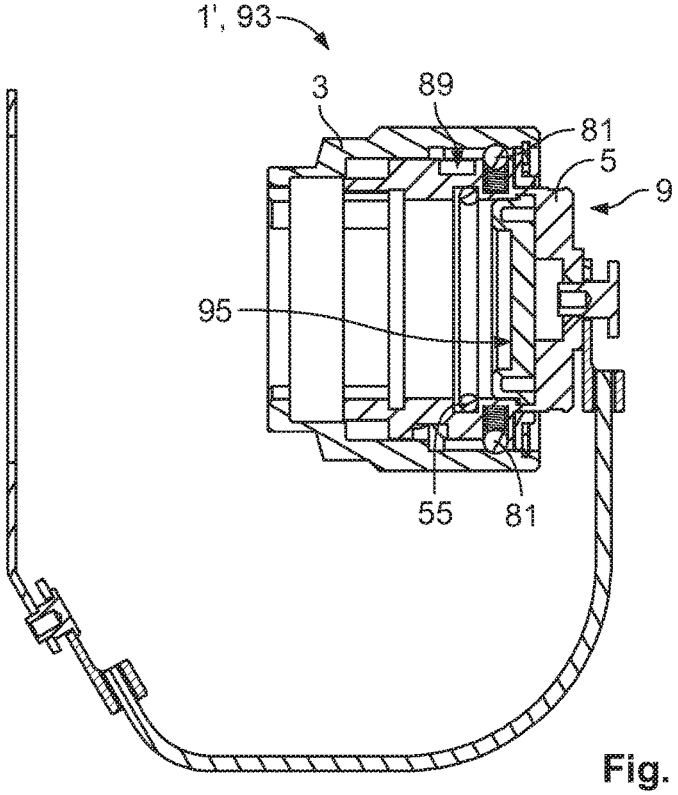
FIG. 8 is a sectional side view of the connector of FIG. 7.

A connector 1' according to another embodiment of the invention is shown in FIGS. 7 and 8. The connector 1' is formed as a protective cover 93 for the mating connector 11. Like reference numbers refer to like elements and only the differences with respect to the connector 1 will be described herein.

Instead of carrying a contact arrangement 57, as shown in FIG. 8, the connector body 5 is closed at its rear end 9. A gasket 95 is arranged in the connector body 5. The gasket 95 presses against the mating connector 11 in a mated state and closes the cylindrically shaped mating connector 11. The protective cover 93 comprises the latching assembly 81 and the drive system 89; the mating and unmating may function as described with respect to the connector 1. During rotation of the fixation sleeve 3 with respect to the connector body 5, the drive system 89 moves the connector body 5 towards the mating connector 11 such that the gasket 95 is pressed against the mating connector 11. The latching assembly 81 provides an audible response when one of the latching positions 77 or 85 is reached.

What is claimed is:

1. A connector, comprising:

a latching assembly;

a connector body;

a fixation sleeve rotatably held on the connector body by the latching assembly between a first latching position and a second latching position, the fixation sleeve at a different angular position relative to the connector body in the first latching position than in the second latching position, the connector body is positioned at a different axial position relative to the fixation sleeve in the first latching position than in the second latching position; and a drive system coupling the fixation sleeve to the connector body and converting a rotation of the fixation sleeve into an axial movement of the connector body, the drive system includes a cam track disposed on the connector body and a pin disposed on the fixation sleeve.

2. The connector of claim 1, wherein the connector body is at least partially disposed inside the fixation sleeve.

3. The connector of claim 1, wherein the fixation sleeve has a fixation element capable of engaging a mating connector matable with the connector.

4. The connector of claim 1, wherein the latching assembly includes an elastically deformable latch disposed on the connector body and a plurality of receiving recesses disposed on the fixation sleeve receiving the latch.

5. The connector of claim 4, wherein the latching assembly includes a plurality of elastically deformable latches disposed on the connector body.

6. The connector of claim 4, wherein the latch includes a compression spring and a ball.

7. The connector of claim 6, wherein the ball is disposed on an end of the compression spring.

8. The connector of claim 7, wherein the compression spring is disposed in an outer circumference of the connector body.

9. The connector of claim 4, wherein the receiving recesses are each formed as a groove in the fixation sleeve extending substantially parallel to a rotational axis of the fixation sleeve.

10. The connector of claim 1, wherein the cam track is disposed on an outer circumference of the connector body and extends around an axis of rotation of the fixation sleeve.

11. The connector of claim 1, wherein the pin extends into the cam track in an assembled state of the connector body and the fixation sleeve.

12. The connector of claim 3, wherein the fixation sleeve has a first alignment member and the connector body has a second alignment member.

13. The connector of claim 12, wherein, in the first latching position, the first alignment member and the second alignment member are aligned to form an insertion path receiving a mating alignment member of the mating connector.

14. The connector of claim 13, wherein, in the second latching position, the first alignment member and the second alignment member are disposed to interrupt the insertion path.

15. A connector assembly, comprising:

a connector including a latching assembly, a connector body, and a fixation sleeve having a fixation element, the fixation sleeve rotatably held on the connector body by the latching assembly between a first latching position and a second latching position and at a different angular position relative to the connector body in the first latching position than in the second latching position; and a mating connector having a counter fixation element complementary to the fixation element, the fixation element locked to the counter fixation element against a mating direction parallel to an axis of rotation of the fixation sleeve in a mated state, the mating connector has a mating alignment member complementary to a first alignment member of the fixation sleeve and a second alignment member of the connector body.

16. The connector assembly of claim 15, wherein the connector is matable with the mating connector only when the fixation sleeve is in the first latching position.

17. A connector, comprising:

a latching assembly;

a connector body; and a fixation sleeve rotatably held on the connector body by the latching assembly between a first latching position and a second latching position, the fixation sleeve at a different angular position relative to the connector body in the first latching position than in the second latching position, the fixation sleeve has a fixation element capable of engaging a mating connector matable with the connector, the fixation sleeve has a first alignment member and the connector body has a second alignment member and, in the first latching position, the first alignment member and the second alignment member are aligned to form an insertion path receiving a mating alignment member of the mating connector.

18. The connector of claim 17, wherein, in the second latching position, the first alignment member and the second alignment member are disposed to interrupt the insertion path.

* * * * *